US010743691B2

(12) United States Patent
Gaines et al.

(10) Patent No.: US 10,743,691 B2
(45) Date of Patent: Aug. 18, 2020

(54) PORTABLE ASSISTIVE SHOE DONNING AND DOFFING DEVICE

(71) Applicant: Christopher Gaines, Silver Spring, MD (US)

(72) Inventors: Christopher Gaines, Silver Spring, MD (US); Eduardo Meza-Etienne, Brunswick, MD (US); H. T. Than, Rockville, MD (US)

( * ) Notice: Subject to any disclaimer, the term of this patent is extended or adjusted under 35 U.S.C. 154(b) by 58 days.

(21) Appl. No.: 16/059,139

(22) Filed: Aug. 9, 2018

(65) Prior Publication Data

US 2020/0046154 A1 Feb. 13, 2020

(51) Int. Cl.
*A47G 25/80* (2006.01)
*A47G 25/84* (2006.01)

(52) U.S. Cl.
CPC ..... *A47G 25/80* (2013.01); *A47G 25/84* (2013.01)

(58) Field of Classification Search
CPC ..... A47G 25/80–86; A47C 16/00; A47C 7/50
See application file for complete search history.

(56) References Cited

U.S. PATENT DOCUMENTS 789,813 A * 5/1905 Longley ..... A47C 16/025 297/423.43
1,453,105 A * 4/1923 Gruss ..... A47G 25/80 223/117
1,636,010 A * 7/1927 Moland ..... A47G 25/80 223/117
3,412,866 A * 11/1968 Binding ..... A47B 61/04 294/162
5,687,889 A 11/1997 Liden
5,741,569 A 4/1998 Votino et al.
6,283,342 B1 9/2001 Wilkerson
6,409,692 B1 6/2002 Covey
6,942,129 B2 9/2005 Ferraioli
7,090,101 B2 8/2006 Engleman
(Continued)

FOREIGN PATENT DOCUMENTS

EP 978244 A1 * 2/2000
WO WO 2015113558 A1 * 8/2015

OTHER PUBLICATIONS

"DressEZ Shoehorn Dressing Aid." RehabMart.com. http://www.rehabmart.com/product/dressez-shoehorn-dressing-aid1-5883.html. May 15, 2017.

(Continued)

*Primary Examiner* — Ismael Izaguirre
(74) *Attorney, Agent, or Firm* — The H.T. Than Law Group

(57) ABSTRACT

Disclosed herein is an assistive shoe donning and doffing device comprising a heel support, a movable toe support and an inclined surface, which is rotatable to adjust an angle of the inclined surface. The inclined surface has at least a plantarflexion foot position, a neutral foot position and a dorsiflexion foot position. The foot positions may be preset, or the inclined surface is rotated in a continuous manner to reach said foot positions. The foot positions may be controlled remotely by a remote controller, a graphical user interface or by voice, and the donning device can sense the location of the shoe on the inclined surface.

8 Claims, 8 Drawing Sheets

(56) References Cited

U.S. PATENT DOCUMENTS

| | | | | |
|---|---|---|---|---|
| 7,634,862 | B2 * | 12/2009 | Cockman | A47G 25/905 223/113 |
| 8,474,666 | B2 | 7/2013 | Vitillo et al. | |
| 8,616,652 | B1 * | 12/2013 | Wells | A47C 16/025 297/423.14 |
| 8,911,021 | B1 * | 12/2014 | Styke | A61G 5/00 297/423.45 |
| 9,332,869 | B1 | 5/2016 | Beaudette | |
| 2002/0000812 | A1 | 1/2002 | Runge | |
| 2003/0071508 | A1 * | 4/2003 | Lu | A47C 16/025 297/423.43 |
| 2010/0014850 | A1 | 6/2010 | Holmes et al. | |

OTHER PUBLICATIONS

"Dressing Aids for the Disabled Can Enhance Independence." Handicapped Equipment. 2017. http://www.handicappedequipment.org/dressing-aids-for-the-disabled-can-enhance-independence/. May 15, 2017.

"Foot Funnel Shoe Assistance: Allows Foot to Easily Slide in Shoe." Caregiverproducts.com. May 15, 2017.

"Good Grips Long Handle Shoe Horn." RehabMart.com. http://www.rehabmart.com.product/good-grips-long-handle-shoe-horn-77.html. May 15, 2017.

"Shoe Boot Assist: Long Handle Shoe Helper." ArthritisSupplies.com. May 15, 2017.

Gaines, Christopher Michael. Portable Assistive Show Device. High School Presentation. Augusta, GA. Mar. 12, 2011.

* cited by examiner

PORTABLE ASSISTIVE SHOE DONNING AND DOFFING DEVICE

FIELD OF THE INVENTION

The present invention relates to a device that assists persons with musculoskeletal problems to independently put on and take off shoes.

BACKGROUND OF THE INVENTION

Donning shoes is generally considered an everyday task that can be completed with relative ease by most people. However, this activity can pose a serious challenge to persons affected by motion limitations associated with musculoskeletal problems. Often, dexterity problems and stability issues prevent persons with physical disabilities from independently donning and doffing their shoes without the assistance of another person.

An assistive device that holds a shoe in place allows a user to insert his or her foot inside a shoe and adjust the foot's placement to ease the difficulties outlined above. Such assistive devices have the capability to conform to the user's shoe size, as well as adapt to an ergonomically effective angle that is comfortable for the user. The device will be adaptable and allow for the placement of a shoe ranging from a child's size 2 to an adult's size 10.5 shoe or larger. The platform where the shoe is placed should aid the donning of most shoe types. However, there is no need to accommodate shoes that are not typically used by disabled people, such as stiletto heels or large working boots.

The Technology-related Assistance for Individuals with Disabilities Act of 1988 first defined assistive technology (AT) as: any item, piece of equipment, or product system, whether acquired commercially off the shelf, modified, or customized, that is used to increase, maintain, or improve functional capabilities of individuals with disabilities. AT service is directly assisting an individual with a disability in the selection, acquisition, or use of an assistive technology device (Public Law 100-407, 1994).

According to the National Multiple Sclerosis Society (2010), assistive devices are usually prescribed by a physiatrist, or by an occupational, physical, or speech/language pathologist, following referral by a physician. Basically, assistive devices enable people who are physically challenged in some way to engage in independent living using these self-aid devices for stability, to eat, bathe, do housework, and to dress without human assistance. Therefore, these devices compensate for functional limitations and improve daily living for persons with physical disabilities. An example is how some individuals who have trouble tying their shoes use hook and loop closures (Velcro™) instead of shoelaces.

The patent literature includes earlier devices intended to assist users with restrictive movements in putting on and taking off their shoes. U.S. Pat. No. 8,474,666 to Vitillo et al describes an ankle foot orthosis (AFO) and shoe donning device that includes an L-shaped AFO cradle with hinged pins for releasable and rotatable engagement to a docking base to stabilize and position the AFO for donning. The Vitillo reference also includes a shoe platform which engages with a docking base. The shoe platform has an inclined upper surface for connecting the docking base with the AFO cradle to stabilize the shoe platform during donning of shoes. U.S. Pat. No. 6,409,692 to Ferraioli discloses another AFO donning device.

U.S. Pat. No. 7,841,631 to Holmes et al presents a shoelace tying device that allows users with limited hand/arm function to tie footwear with shoelaces. The shoelace tying device alleviates the need for specialized shoelaces or shoes with Velcro™.

A "Shu-Ez" assistive device was designed by Christopher M. Gaines circa 2011, and one of the prototypes is illustrated in FIGS. 1A-1C. Assistive device 1 has a horizontal base and an inclined surface 2, which has a heel support 3 and a toe support 4. Toe support 4 is movable by sliding on tracks 5 and has downwardly facing studs 6. that ride within tracks 5. Toe support 4 slides up and down inclined surface 2 to allow various sizes of shoes to be placed and supported on inclined surface 2. Threaded fastener 7 is provided to lock toe support 4 in place, once assistive device 1 is adjusted.

There remains a need to update the prior art devices to provide improved assistance to users with impaired mobility.

SUMMARY OF THE INVENTION

Hence, the invention is directed to improvements to Gaines' Shu-Ez device. Several embodiments of the present invention modernize the earlier Gaines device and include several features to improve the user-friendliness of the device.

One embodiment of the invention is directed to a portable assistive shoe donning device that includes electromechanical components to control the size of the area that holds the shoe, and to control the angle of the inclined surface.

Another embodiment is directed to a portable assistive shoe donning device that can be controlled remotely, for example, by a remote controller, a blue-tooth connectable smart speaker, such as an Echo™ or a Google® device connected to the assistive shoe donning device, or a near field communication (NFC) or radio frequency (RF) capable electronic device, such as a smart phone or tablet connected to the assistive shoe conning device.

Another embodiment of the present invention is related to a portable assistive shoe donning device that can interactively communicate with the users, such that the inventive shoe donning device may assist the users via voice or visual communication to adjust their feet on the device to achieve an optimal or comfortable position to put on or take off shoes.

An embodiment of the present invention is related to an assistive shoe donning device comprising a heel support and a movable toe support disposed on an inclined surface, which is adapted to receive a shoe. The inclined surface is rotatable to adjust an angle of the inclined surface and the inclined surface has at least a plantar flexion foot position, a neutral foot position and a dorsiflexion foot position. The foot positions may be preset, or the inclined surface is rotated in a continuous manner to reach said foot positions.

In other embodiments, the assistive shoe donning device may further comprise a manually operated threaded member to raise or lower a toe-side end of the inclined surface to vary the angle of the inclined surface or a motor that raises or lowers the inclined surface to vary angle of the inclined surface. A circuit that connects to the motor to power the motor may have comprise a microprocessor that stores setting for each of said foot positions. The circuit may be controlled remotely by a remote device. The remote device may comprise a remote controller. The remote device may be a smart computing device, which includes but is not limited to a smart speaker, a smart phone, a smart tablet or a laptop.

In another embodiment, the inclined surface comprises a plurality of pressure transducers to ascertain the position of the shoe, and the plurality of the pressure transducers sense the position of the shoe.

BRIEF DESCRIPTION OF THE DRAWINGS

In the accompanying drawings, which form a part of the specification and are to be read in conjunction therewith and in which like reference numerals are used to indicate like parts in the various views:

FIG. 4A;

DETAILED DESCRIPTION OF THE PREFERRED EMBODIMENTS

Figure 1A:
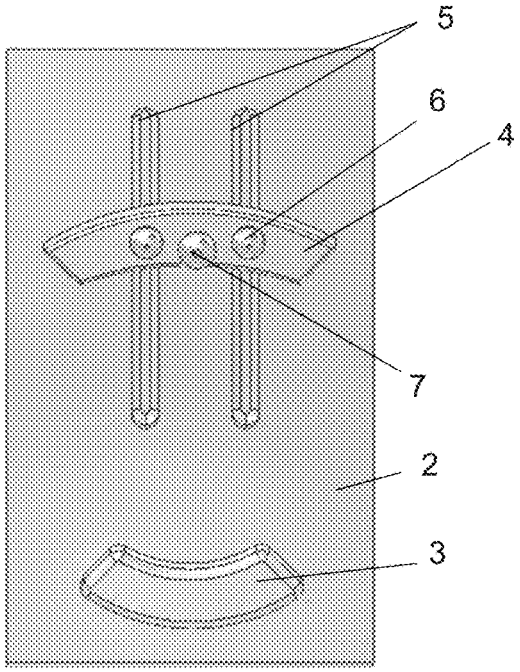
Figure 1A (Prior Art)
FIG. 1A is a top view.
Figure 1B:
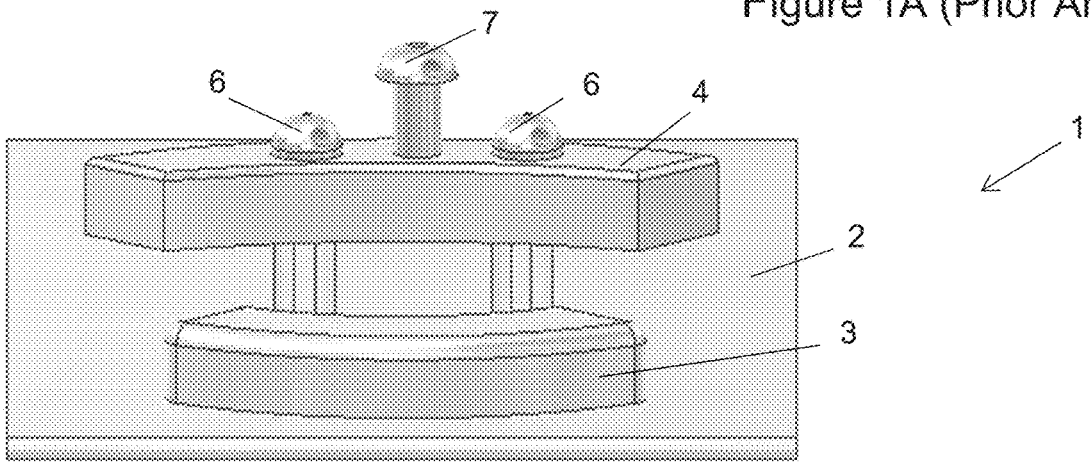
Figure 1B (Prior Art)
FIG. 1B is a front view and FIG. 1C is a side view of a prior art assistive shoe donning device.
Figure 1C:
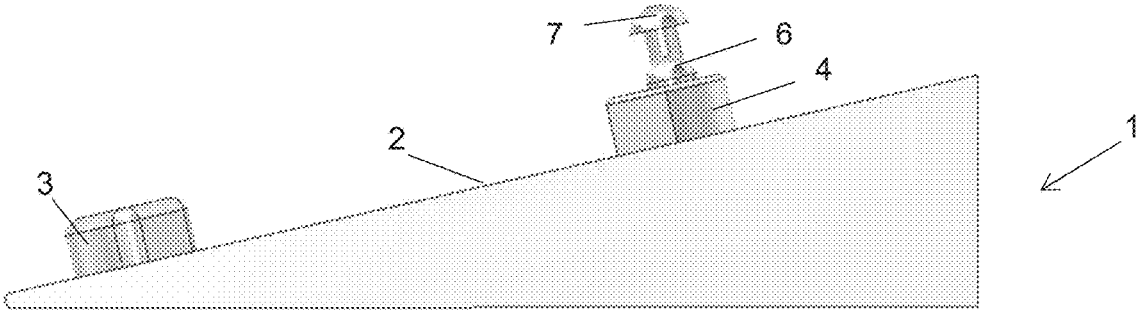
Figure 1C (Prior Art)
Figure 2A:
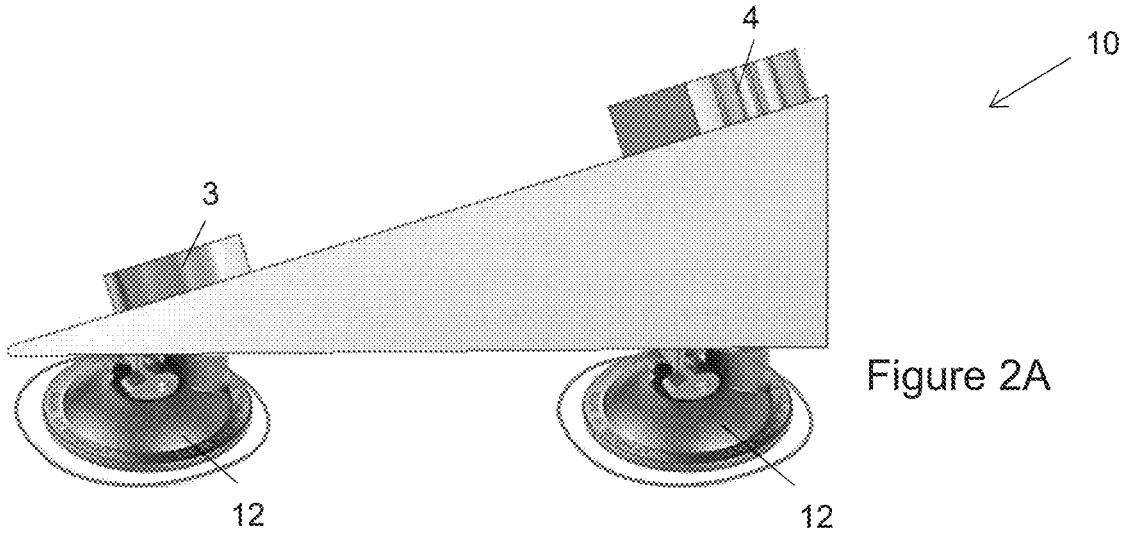
FIGS. 2A and 2B are side views of the improved assistive shoe donning device of the present invention.
Figure 2B:
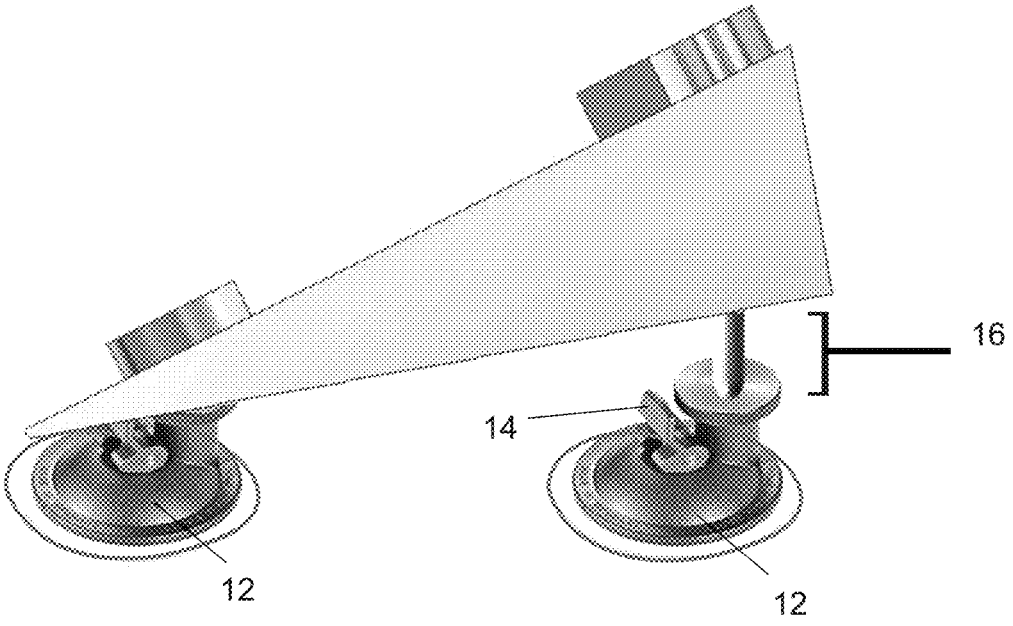

Referring to FIGS. 2A and 2B, an improved shoe donning device 10 is shown with suction feet 12, which have engage/release lever 14 to attach the suction feet to a flat smooth surface and to release same. Donning device 10 retains a horizontal base and an inclined surface 2, which has a heel support 3 and a toe support 4, as well as the other features shown in FIGS. 1A-1C. Donning device 10 further has height adjuster 16, which in this nonlimiting example has a threaded member, such as a corkscrew that is rotatable to raise or lower the toe-end of donning device 10.

Figure 3A:
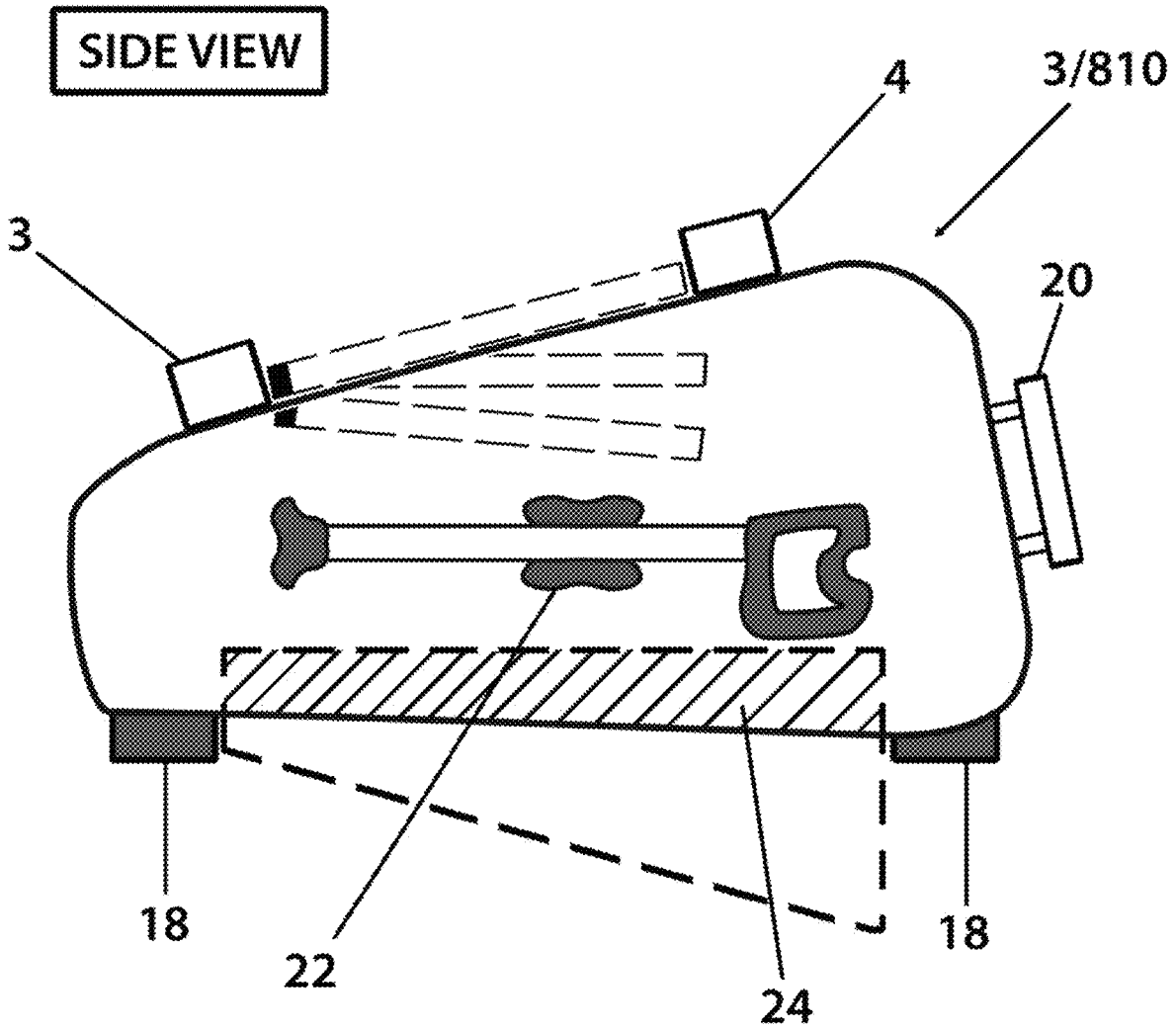
FIG. 3A is a side view of a schematic rendering of another improved assistive shoe donning device (not to scale)
Figure 3B:
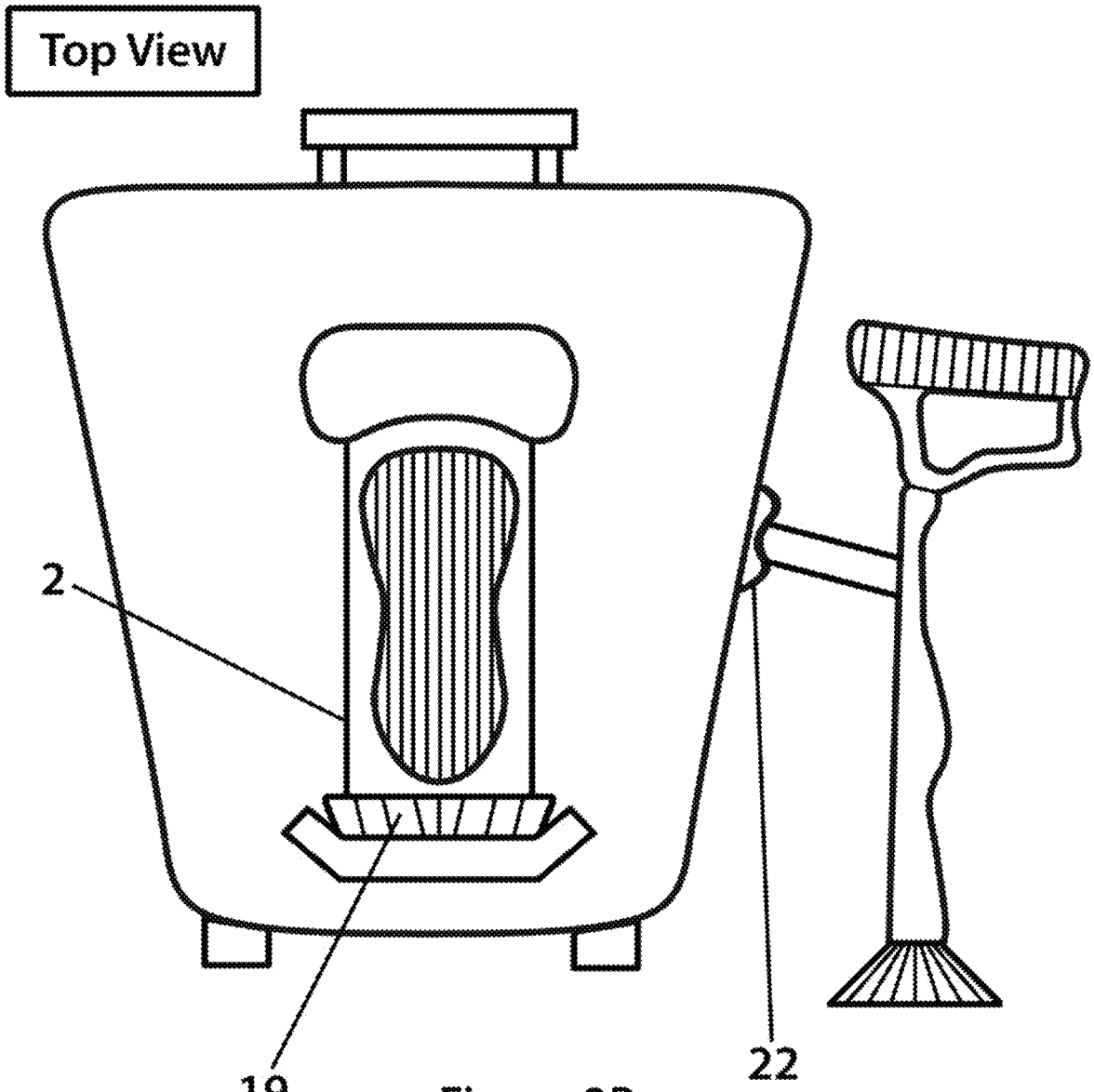
FIG. 3B is a top view of the embodiment shown in FIG. 3A.

FIGS. 3A and 3B show another embodiment of the inventive donning device 10. In this embodiment, inclined surface 2 of donning device 10 preferably has three preset positions. Position 1 has a downward orientation that corresponds to a plantarflexion foot position; position 2 refers to a neutral foot position; and position 3 refers to a dorsiflexion foot position. Alternatively, instead of preset positions the angle or orientation of inclined surface 2 can be adjusted continuously using height adjuster 16 shown in FIG. 2B. Hinge 19 preferably attached inclined surface 2 to donning device 10 to allow inclined surface 2 to rotate about hinge 19 to elevate inclined surface 2.

This embodiment also includes additional user-friendly features for the users. Non-skid feet 18 are provided to ensure firm positioning of donning device 10 on a surface. Handle 20 is provided to allow easy handling and portability. Since the users of donning device 10 have limited mobility and may need a walking cane, a snap holder or clip 22 is provided to hold the cane while the users are donning on shoes. An optional storage area 24 with a latched door is provided at the bottom surface of donning device 10.

Figure 4A:
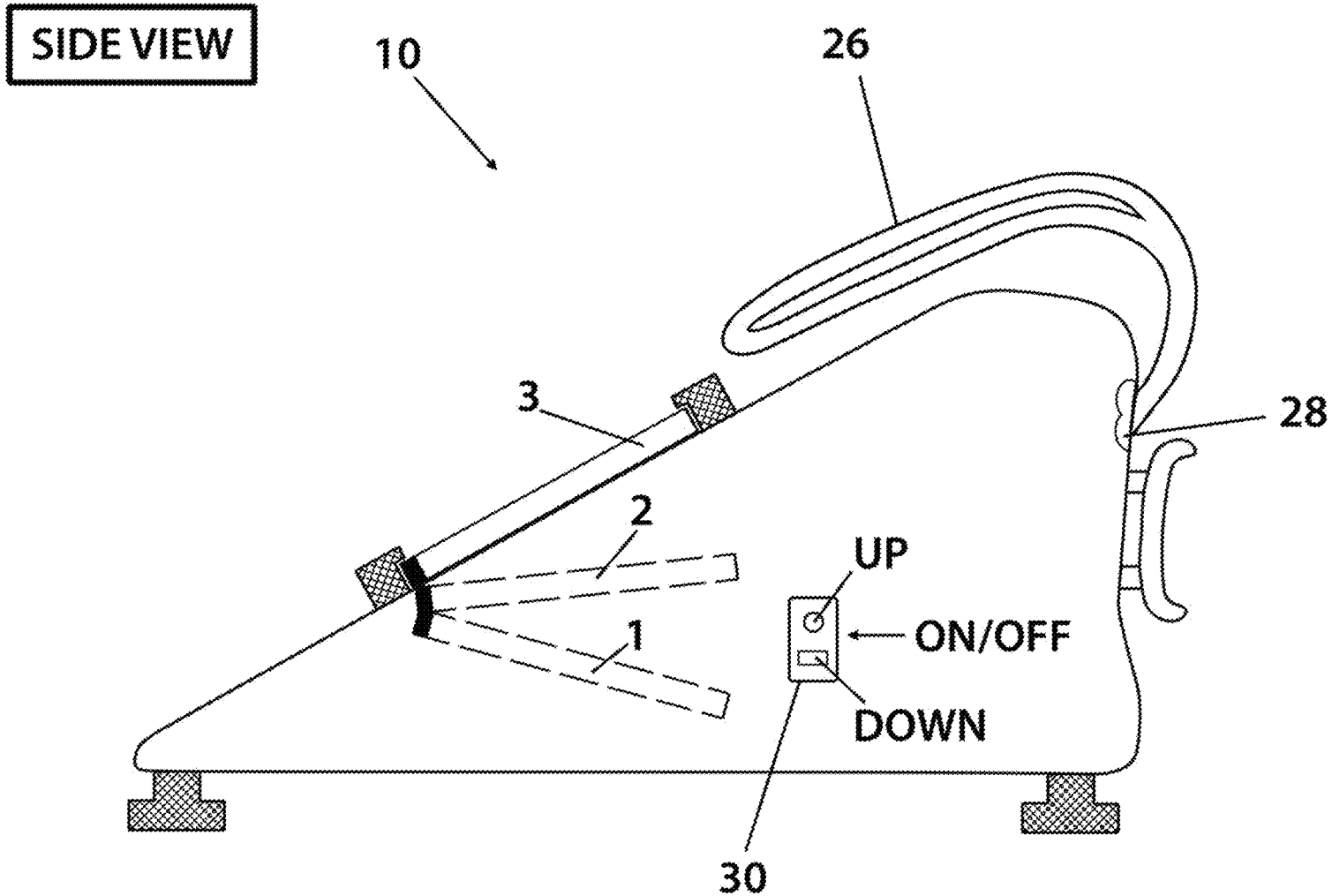
FIG. 4A is a side view of a schematic rendering of another improved assistive shoe donning device.

In another embodiment shown in FIG. 4A, a rotatable and lockable handle 26 connected at hinge 28 to the body of donning device 10. When fully raised and locked, handle 26 allows the users to grip it to steady themselves when donning on or taking off shoes. When finished, handle 26 can be rotated downward as shown and locked to allow convenient storage.

Figure 4B:
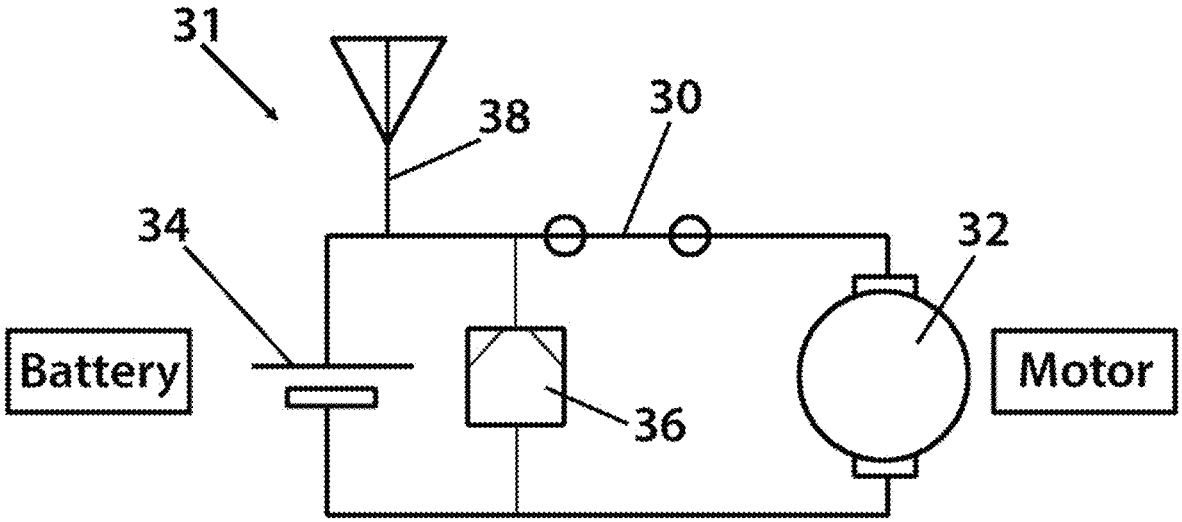
FIGS. 4B-C are schematics of an electrical control circuit of an electromechanical.
Figure 4C:
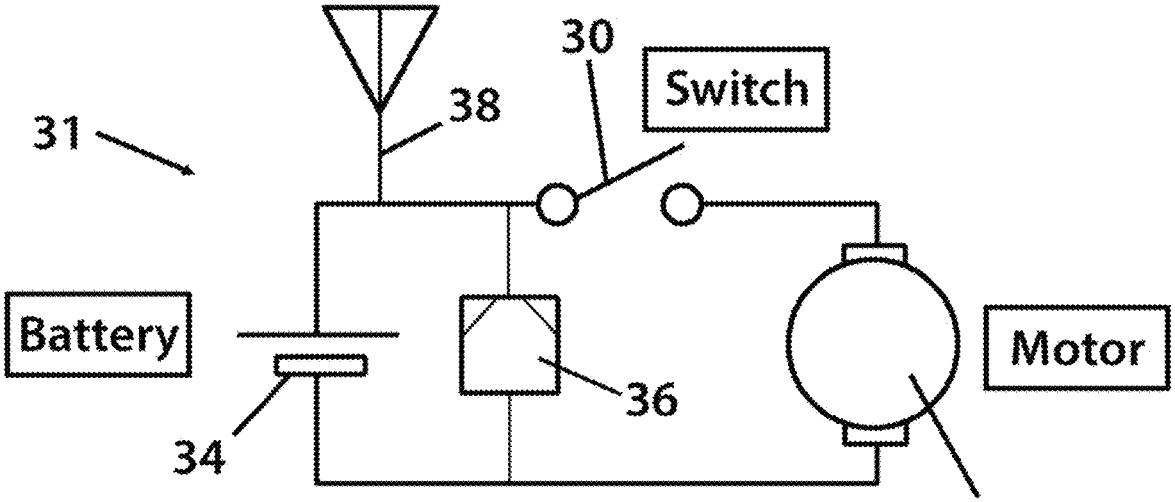

The embodiment of FIG. 4A also has an electrical motor positioned inside the housing, which is electrically connected switch 30. Switch 30 may be an ON/OFF switch, or a toggle switch that if an UP portion is pushed the inclined surface would move up and if a DOWN portion is pushed the inclined surface would move down. The electrical circuit 31 that controls the motor is illustrated in FIGS. 4B-4C. Motor 32 is connected to power source 34, which can be a battery or a main A/C power source.

In an alternative embodiment, circuit 31 has microprocessor 36 that controls motor and its operation. Antennae 38 is provided to receive remote instructions from the users. Preferably, the users operate a remote control that is tuned to a frequency or wavelength that is receivable by controller 36 and antennae 38. By operating the remote control, users can set the inclined angle of inclined surface 2 and may raise and lower handle 26 if another motor is attached thereto. Preferably, microprocessor 36 stores the settings for the positions 1, 2 or 3 of the inclined surface 2 and when the command or instruction is received microprocessor 36 sends instructions to motor 32 to reposition inclined surface 2.

In an alternative embodiment, the remote control is replaced with a smart speaker, such as the Echo™ or a Google® smart speaker. Following the established protocols from Amazon.com or Google for their smart speaker, the donning device of the present invention can be connected via blue tooth to a residence's WiFi system that the smart speaker is connected to. Users can speak to the smart speaker using verbal commands to control donning device 10. Examples of verbal commands include, but are not limited to:

"Alexa, power on"
"Alexa, power off"
"Alexa, Level 1"
"Alexa, Level 2"
"Alexa, Level 3"
"Alexa, move from Level 1 to 2, Level 2 to 3, Level 3 to 2, etc,"

Of course, "Alexa" would be replaced by "Hey, Google" if the Google smart speaker is used. In a preferred embodiment processor 36 of circuit 31 is programmed to receive instructions via blue-toothed wavelengths. Protocols to connect donning device 10 or any other smart device to a smart speaker such as the Echo™ can be found at https://developer.amazon.com/alexa-voice-service.

Figure 5:
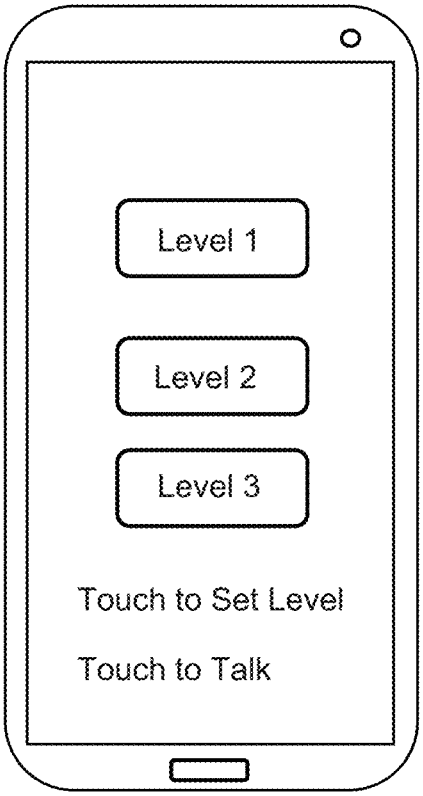
FIG. 5 shows a typical graphical user interface usable with the present invention.

Alternatively, software or an APP can be developed and downloaded to the user's smart phone, smart tablet, or laptop. The APP would have the appropriate graphical user interface (GUI) to allow the users to select the proper position for inclined surface 2, as illustrated in FIG. 5. Alternatively, the APP can use the smart phone's voice recognition capability to transmit commands to processor 36 of donning device 10. A smart phone can communicate wirelessly to donning device 10 via blue-tooth, WiFi, NFC or radio frequency (RF). The present invention is not limited to any particular smart device or transmission mode.

Figure 6:
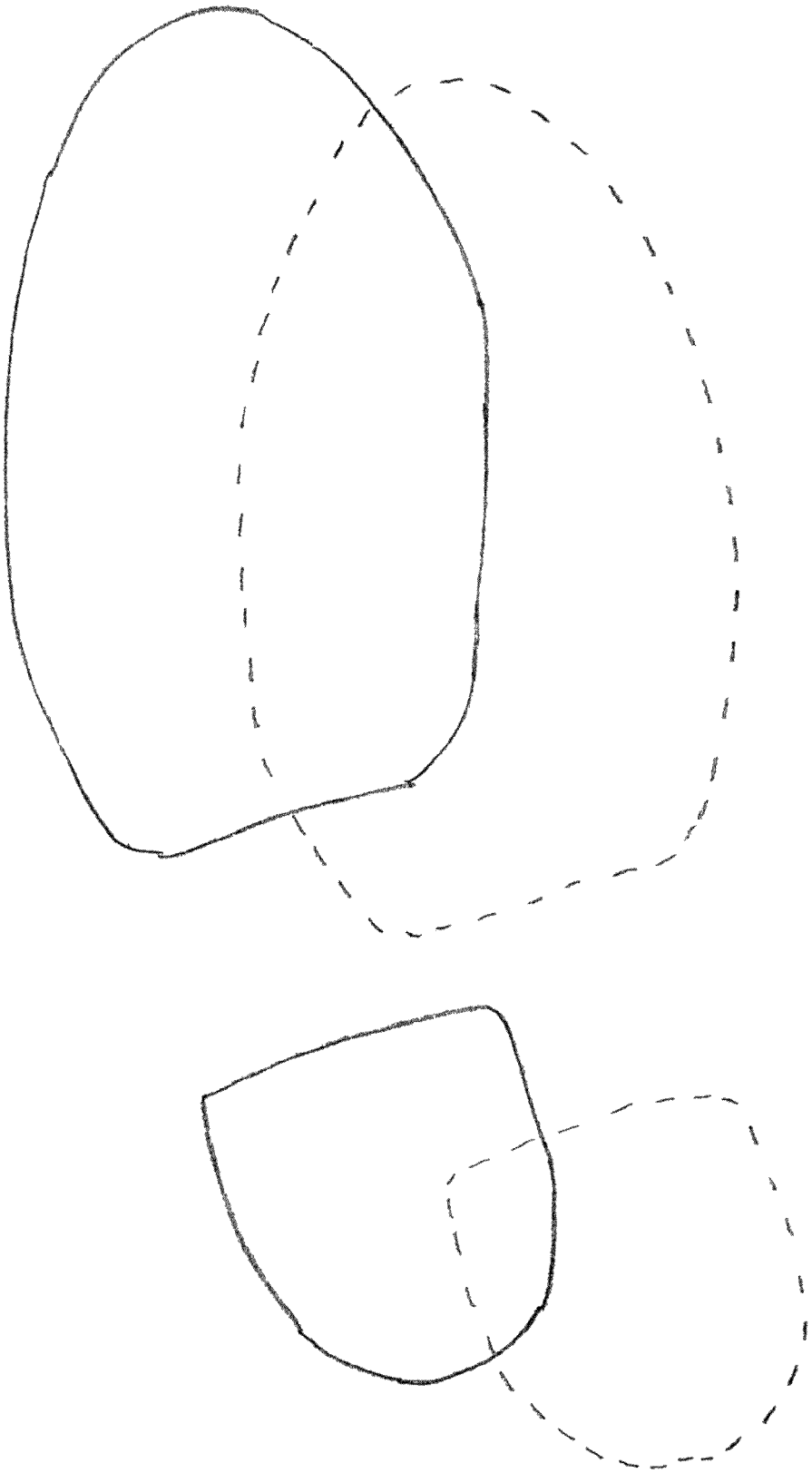
FIG. 6 is a schematic view of an inclined surface with pressure transducers.

In yet another embodiment of the present invention as illustrated in FIG. 6, inclined surface 2 has a two-dimensional array of pressure transducers placed on or below it. Depending on the shoe size or left/right foot, processor 36 expects that when a shoe is properly positioned on inclined surface 2, certain pressure transducers would register a reading, i.e., the shoe is placed directly on these transducers. If some of these transducers do not register a reading, then the shoe is partially misplaced, and the smart device (speaker, phone, table or labtop) connected to donning device 10 can inform the users either through the GUI or voice communication to reposition the shoe.

As shown in FIG. 6, the solid line indicates the correct position of the shoe and the broken line illustrates a possible misplacement of the shoe. Processor 36 can also determine which direction, e.g., up, down, left and/or right, that the shoe should be moved. For example, as shown in FIG. 6, if each square represents a pressure transducer, processor 36 can determine that the left and top transducers do not register readings. While the readings may be different among the transducers due to uneven pressure exerted by the shoe, a positive reading indicates that the shoe is on top of the transducer. Processor 36 can communicate to the users, if necessary, to move the shoe a certain direction and distance. A touchscreen, either resistive or capacitive (http://science-line.org/2012/01/okay-but-how-do-touch-screens-actually-work/) typically used on ATMs, smart phone/tablet can be used as an array of transducers. The present invention is not limited to touchscreens and individual pressure transducers may be installed on or below inclined surface 2.

While it is apparent that the illustrative embodiments of the invention disclosed herein fulfill the objectives stated above, it is appreciated that numerous modifications and other embodiments may be devised by those skilled in the art. Features or elements from one embodiment can be used with any other embodiments. Therefore, it will be understood that the appended claims are intended to cover all such modifications and embodiments, which would come within the spirit and scope of the present invention.

What is claimed is:

1. An assistive shoe donning device comprising a heel support and a movable toe support disposed on an inclined surface, which is adapted to receive a shoe, wherein the inclined surface is rotatable to adjust an angle of the inclined surface, wherein the inclined surface has at least a plantarflexion foot position, a neutral foot position and a dorsiflexion foot position, wherein said foot positions may be preset or the inclined surface is rotated in a continuous manner to reach said foot positions, and wherein the assistive shoe donning device further comprises a manually operated threaded member to raise or lower a toe-side end of the inclined surface to vary the angle of the inclined surface.

2. An assistive shoe donning device comprising a heel support and a movable toe support disposed on an inclined surface, which is adapted to receive a shoe, wherein the inclined surface is rotatable to adjust an angle of the inclined surface, wherein the inclined surface has at least a plantarflexion foot position, a neutral foot position and a dorsiflexion foot position, wherein said foot positions may be preset or the inclined surface is rotated in a continuous manner to reach said foot positions, wherein the assistive shoe donning device further comprises a motor that raises or lowers the inclined surface to vary angle of the inclined surface, and wherein a circuit that connects to the motor to power the motor comprises a microprocessor that stores setting for each of said foot positions.

3. The assistive shoe donning device of claim 2, wherein the circuit is controlled remotely by a remote device.

4. The assistive shoe donning device of claim 3, wherein the remote device comprises a remote controller.

5. The assistive shoe donning device of claim 3, wherein the remote device comprises a smart computing device.

6. The assistive shoe donning device of claim 3, wherein the remote device is a smart speaker, a smart phone, a smart tablet or a laptop.

7. An assistive shoe donning device comprising a heel support and a movable toe support disposed on an inclined surface, which is adapted to receive a shoe, wherein the inclined surface is rotatable to adjust an angle of the inclined surface, wherein the inclined surface has at least a plantarflexion foot position, a neutral foot position and a dorsiflexion foot position, wherein said foot positions may be preset or the inclined surface is rotated in a continuous manner to reach said foot positions, wherein the inclined surface comprises a plurality of pressure transducers to ascertain the position of the shoe.

8. The assistive shoe donning device of claim 7, wherein the plurality of the pressure transducers sense the position of the shoe.

* * * * *